US006910843B2

(12) United States Patent
Saw et al.

(10) Patent No.: US 6,910,843 B2
(45) Date of Patent: Jun. 28, 2005

(54) COVER AUTHORING SYSTEMS AND METHODS AND BOOKBINDING SYSTEMS INCORPORATING THE SAME

(75) Inventors: Chit Wei Saw, Cupertino, CA (US); Hui Chao, San Jose, CA (US); Giordano B. Beretta, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 348 days.

(21) Appl. No.: 09/991,951

(22) Filed: Nov. 26, 2001

(65) Prior Publication Data

US 2003/0099526 A1 May 29, 2003

(51) Int. Cl.[7] ..... B41J 1/00; B41B 1/00

(52) U.S. Cl. ..... 412/19; 412/4; 412/8; 412/16; 412/32; 270/1.02; 270/1.03; 270/21.1; 358/1.1; 358/1.15; 358/1.18; 345/961; 715/517; 715/520; 715/522; 715/523; 715/524; 715/525; 715/968; 715/969

(58) Field of Search ..... 358/1.1, 1.18, 358/1.15; 345/961; 715/517, 520, 522, 523, 524, 525, 968, 969; 412/4, 8, 16, 19, 32; 270/1.02, 1.03, 21.1

(56) References Cited

U.S. PATENT DOCUMENTS 5,174,556 A 12/1992 Taylor et al.
5,213,461 A * 5/1993 Kalisher ..... 412/4
5,465,213 A * 11/1995 Ross ..... 700/117
5,547,176 A * 8/1996 Williams et al. ..... 270/37
5,724,075 A 3/1998 Smith
5,735,659 A * 4/1998 Kosasa et al. ..... 412/9
5,774,688 A * 6/1998 Georgitsis et al. ..... 703/1
5,782,598 A * 7/1998 Salzberger ..... 412/4
5,832,193 A * 11/1998 Perine et al. ..... 358/1.18
6,012,890 A * 1/2000 Celorio Garrido ..... 412/19
6,213,703 B1 * 4/2001 Garrido ..... 412/19
6,322,262 B1 * 11/2001 Trosterud ..... 400/70
6,535,791 B1 * 3/2003 Wang ..... 700/235
6,602,175 B2 * 8/2003 Zahn ..... 493/378
6,616,702 B1 * 9/2003 Tonkin ..... 715/515
2002/0001102 A1 * 1/2002 Williams ..... 358/1.18
2002/0057453 A1 * 5/2002 Michaelis et al. ..... 358/1.15
2002/0097407 A1 * 7/2002 Ryan et al. ..... 358/1.1

FOREIGN PATENT DOCUMENTS

WO WO 00/01540 1/2001
WO WO 01/00423 1/2001
WO WO01/00423 A2 * 1/2001

* cited by examiner

*Primary Examiner*—Derris H. Banks
*Assistant Examiner*—Mark Henderson

(57) ABSTRACT

Cover authoring systems and methods for automatically composing a final content layout for a cover, including spinal content formatted to accommodate the width and height dimensions of the book spine, are described. By automatically computing the typeface parameter values based upon the selected visual fit model, this cover authoring scheme enables users to avoid the time consuming, laborious and expensive process of manually composing the final cover content layout with a conventional graphics program.

36 Claims, 3 Drawing Sheets

COVER AUTHORING SYSTEMS AND METHODS AND BOOKBINDING SYSTEMS INCORPORATING THE SAME

TECHNICAL FIELD

This invention relates to systems and methods of cover authoring and bookbinding systems incorporating the same.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system that is designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets or signatures into a text body (or book block) that includes a spine (or backbone) and two side hinge areas. The bookbinding system applies a flexible adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of perfectly bound hardcover books and some soft cover "lay flat" books, on the other hand, typically are not attached to the text body spines (i.e., the spines are "floating").

Traditionally, the copy for covers of short on-demand runs of perfectly bound books have been created manually by a graphic artist or a typesetter. In this regard, the graphic artist or typesetter manually formats the cover for the book, places the title on the cover, and reconfigures the original document to fit the desired final book size. In this process, the graphic artist or typesetter typically determines the size of the cover, including the spine area, so that the cover will wrap around the document perfectly. In general, this traditional manual bookbinding process involves a substantial amount of labor and time.

Recently published International Patent Publication WO 01/00423 describes a system for automating the creation of a printing master and a template for a cover that is sized to wrap around a document to form a perfectly bound book. The system prepares the document for binding by setting up page-by-page printing instructions, scaling the document (if required), and setting up a template for the cover. The system sets up printing instructions for the document by collecting instructions for each page "range" in the book. The operator of the system may specify the type of paper to be used for each of the page ranges and the printing format. After the page range printing instructions have been specified, the system determines the size requirements for the cover based on the size of the original file and the thickness of the document, which is based on the type of paper used and the number of pages involved for each type of paper. The system scales the text and page size to fit within the cover. The operator may print the scaled document file to form the internal pages of the book and the cover template file to form the cover of the book. Before the operator prints out the cover, however, the operator must edit the cover template file manually in order to add such items as the title, the author's name and graphical content to the cover.

SUMMARY

The invention features cover authoring systems and methods for automatically composing a final content layout for a cover, including spinal content formatted to accommodate the thickness and height dimensions of the book spine. In this way, the invention avoids the time consuming, laborious and expensive process of manually composing the final cover content layout with a conventional graphics program (e.g., the Macromedia® FreeHand® or Adobe® Illustrator® graphics programs).

In one aspect, the invention features a cover authoring tool, comprising an interface and a cover content layout engine. The interface is configured to receive size information for a document to be bound into a perfectly bound book having a spine characterized by a width dimension and a height dimension, and to receive content information for a cover to be attached to the perfectly bound book. The cover content layout engine is configured to compose a final content layout for the cover, including spinal content formatted to accommodate the width and height dimensions of the book spine based upon the document size information and the cover content information received through the interface.

Embodiments of the invention may include one or more of the following features.

The cover content layout engine preferably is configured to compute the thickness dimension of the perfectly bound book from the received document size information. The received document size information preferably includes type of paper and number of pages in the perfectly bound book.

The received cover content information (or copy) may include graphical content and textual content. The interface may comprise a graphical user interface through which a user may specify content and content layout for the cover. The graphical user interface may be configured to present multiple pre-generated cover styles for selection by the user. The cover content layout engine may be configured to compose the final content layout for the cover based upon a pre-generated cover style selected by the user. The cover content layout engine may be configured to conform a spinal region of the selected pre-generated cover style to the width dimension of the book spine.

The cover content layout engine preferably is configured to select typeface parameter values (or design axes) for spinal text content consisting of a number of characters. The typeface parameter values may be selected based at least in part upon the number of characters of spinal text content and the height and width dimensions of the book spine. Values may be selected for one or more of the following typeface parameters: weight axis (e.g., from light to black), width axis (e.g., from condensed to extra-extended), style axis (e.g., from sans serif to serif), and optical size axis (i.e., optical adjustment of type so letter proportion, weight, stroke, contrast, and spacing are optimized for readability at a specified point size). The font variation may be selected from the group consisting of a regular font face, a condensed font face and an expanded font face. In some embodiments, a multiple master typeface may be specified. In such a typeface, a font may be generated algorithmically for virtually any weight, width, or optical size while still preserving the integrity of the type's design and the legibility of the spine.

In another aspect, the invention features a cover authoring method in accordance with which size information for a document to be bound into a perfectly bound book having a spine characterized by a width dimension and a height dimension is received. Content information for a cover to be attached to the perfectly bound book also is received. A final content layout for the cover, including spinal content formatted to accommodate the width and height dimensions of the book spine is composed based upon the received document size information and the received cover content information.

In another aspect, the invention features a bookbinding system, comprising a sheet composer, a sheet binder, the above-described cover authoring tool, and cover binder. The sheet composer is configured to format a document to be bound into a perfect bound and to print the formatted document onto two or more sheets. The sheet binder is configured to form from the two or more printed sheets a text body having an exposed spine characterized by a width dimension and a height dimension. The cover binder is configured to attach the cover to the text body.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
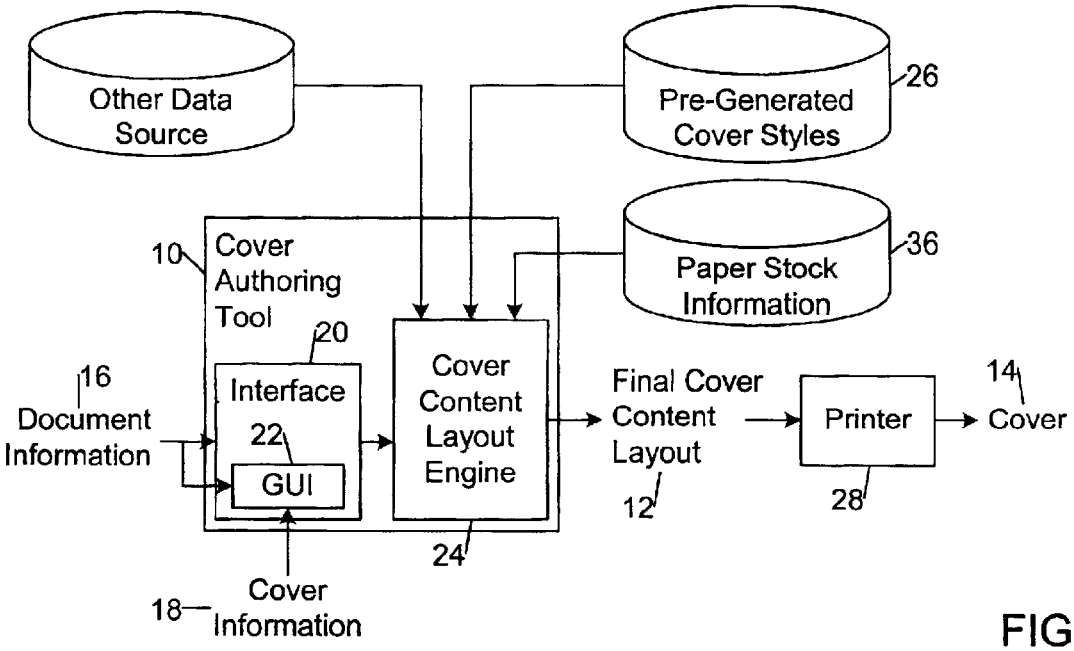
FIG. 1 is a block diagram of a cover authoring tool, a database of pre-generated cover styles, a database of paper stock information, and a printer.

Referring to FIG. 1, in one embodiment, a cover authoring tool 10 is configured to automatically compose a final content layout 12 for a cover 14, which is to be attached to a bound text body, based upon document information 16 and cover information 18 that are received through an interface 20. Some of the document information 16 (e.g., number of pages in the document) may be received from one or more preceding modules or processes in a bookbinding workflow, while other document information 16 (e.g., document file information) may be received from a user through a graphical user interface (GUI) 22. Information 18 relating to cover 14 also may be received through GUI 22, a database, or other data source. In some embodiments, pre-saved information may be retrieved from a database based upon a job ID entered through GUI 22. In these embodiments, a previously saved job may be re-run simply by entering the corresponding job ID. The document information 16 and the cover information 18 are passed to a cover content layout engine 24 for processing. Based upon the document information 16 and the cover information 18, the cover content layout engine 24 is operable to automatically compose final cover content layout 12, including spinal content that is formatted to accommodate the width and height dimensions of the spine of the perfectly bound book to be produced. In some embodiments, cover authoring tool 10 may retrieve multiple pre-generated cover styles from a database 26 for presentation to a user through GUI 22. The user may select one of the pre-generated cover styles for use as a framework on which to base the final cover content layout 12. Each of the pre-generated cover styles includes formatting information for composing final cover content layout 12 from cover information 18. The final cover content layout 12 may be transmitted to a printer 28 or other rendering device to produce cover 14. The final cover content layout 12 may be in the form of a computer document file formatted in accordance with the Adobe® Portable Document Format® (PDF).

Figure 2:
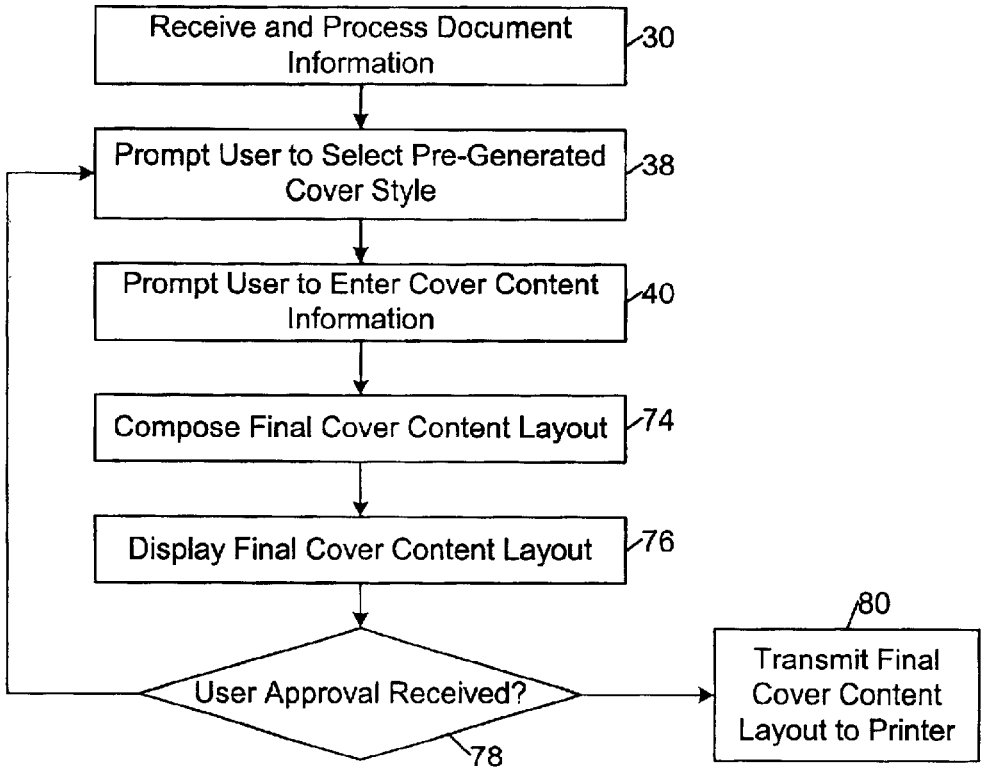
FIG. 2 is a flow diagram of a cover authoring method that may be carried out by the cover authoring tool of FIG. 1.

Referring to FIGS. 2, 3, 4 and 5, and initially to FIG. 2, in one embodiment, cover authoring tool 10 may automatically compose final content layout 12 for cover 14 as follows.

Figure 3:
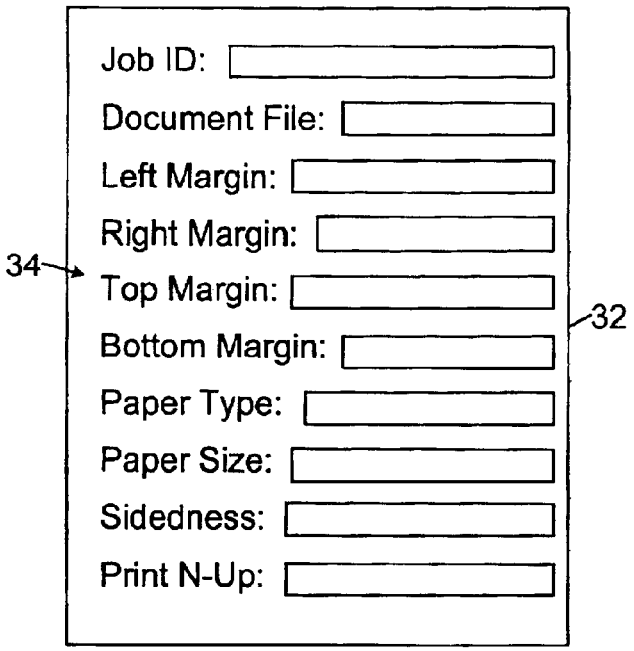
FIG. 3 is a diagrammatic view of a graphical user interface prompting a user to enter information relating to a document to be bound into a perfectly bound book.

Cover authoring tool 10 initially receives and processes document information 16 (step 30). As mentioned above, some of the document information 16 may be received from one or more preceding modules or processes in a bookbinding workflow, while other document information 16 may be received from a user through graphical user interface (GUI) 22 or retrieved from a database. As shown in FIG. 3, cover authoring tool 10 may present to the user a document information input GUI 32, which prompts the user to enter data for a set of document information parameters 34. In general, cover authoring tool 10 may be configured to prompt the user to enter information specifying the way in which the document pages should be scaled and formatted in the final perfectly bound book. In the illustrated embodiment, the user is prompted to enter the following document information: Job ID; Document File; Left Margin; Right Margin; Top Margin; Bottom Margin; Paper Type; Paper Size; Sidedness; and whether the document should be printed N-Up or not. The Job ID parameter identifies the particular bookbinding job. The Job ID may correspond to the user's name or some other identifier. The Document File parameter identifies the input document file (e.g., file name and storage location) from which the final printed document will be generated. The document file may be stored on a portable computer readable medium (e.g., a CD ROM or a DVD ROM) that may be loaded into a drive that may be accessed by cover authoring tool 10. Alternatively, the document file may be transmitted electronically to cover authoring tool 10 over a network (e.g., the Internet). The Margin parameters correspond to the four margins for each page of the document to be printed and may be expressed in conventional measure units (e.g., millimeters or inches). The Paper Type parameter specifies the type of paper on which the document is to be printed and may be expressed in a conventional way (e.g., branch code label+name+media category; see, e.g., WO 01/00423, which is incorporated herein by reference). The Sidedness parameter specifies whether the document is to be printed single-sided or double-sided. Finally, the Print N-Up parameter specifies the number of pages that will be printed on the same side of a single sheet of paper. In the N-Up format, N page images of the document are printed on the same side of a single sheet of paper; the page images may be the same so that N books may be formed during a single print job, or they may be different.

Other embodiments may prompt the user to enter more, less or different document information than the illustrated embodiment. In other embodiments, the document information parameters 34 may be obtained by a preceding (or upstream) module or process in a bookbinding workflow, in which case the user would not be prompted to enter this information at this stage.

In addition to the document information received from the user through GUI 32, cover authoring tool 10 may receive some document information from a paper stock database 36 (see FIG. 1), which contains a list of the dimensions and thicknesses for each of the possible Paper Types that may be selected by the user. This information may be used by cover content layout engine 24 to compute the width of the spine of the text body, a measure which is used by cover content layout engine 24 to compose the final cover content layout 12. The width of the spine may be computed from the bulk of the paper, where bulk is defined as the degree of thickness of paper. In book printing, the bulk is the number of pages per inch for a given basis weight. The basis weight is the weight in pounds of a ream (e.g., 500 sheets) of paper cut to a given standard size for that grade (e.g., 20×26 square inches for cover papers).

Figure 4:
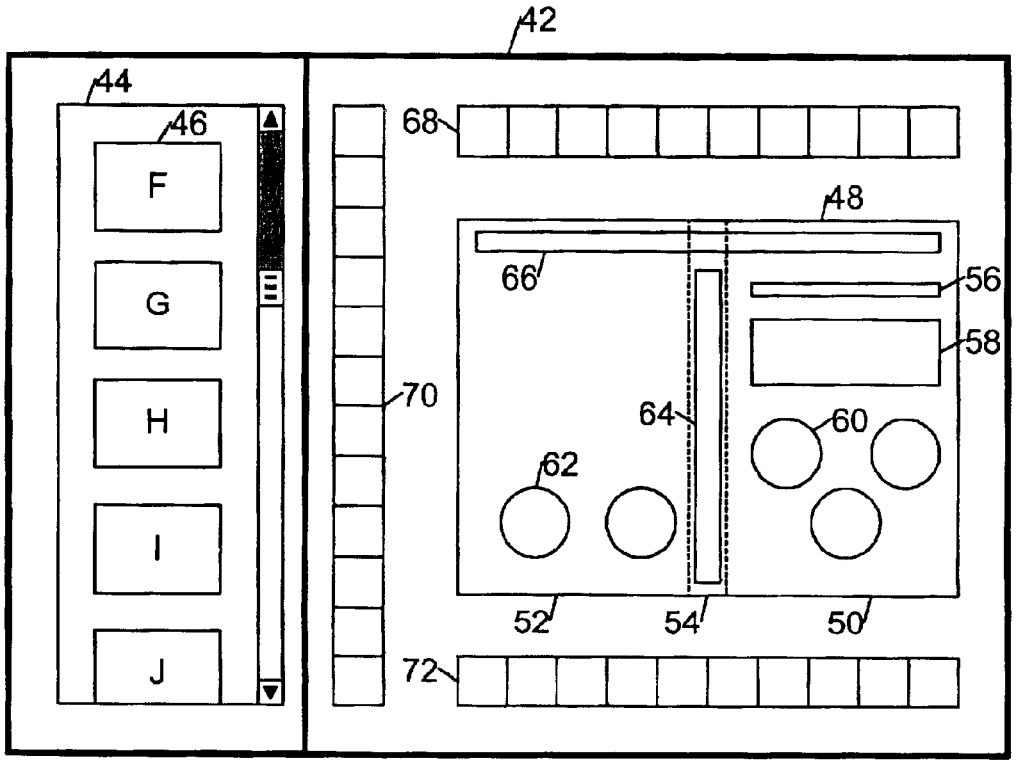
FIG. 4 is a diagrammatic view of a graphical user interface prompting a user to enter information relating to a cover to be attached to a text body of a perfectly bound book.

Next, the user is prompted to input cover information 18. As shown in FIG. 4, the user may be prompted to select a pre-generated cover style (step 38; FIG. 2) and to enter cover content information (step 40; FIG. 2) through a GUI 42. In the illustrated embodiment, the user may select through a cover style selection window 44 one of the multiple pre-generated cover styles 46 that are stored in database 26. In operation, the user may use a pointing device (e.g., a computer mouse) to scroll through and select one of the available cover styles 46 that are presented in cover style selection window 44. Each cover style 46 may include a specification for the placement of various kinds of cover content elements, including textual content (e.g., author and title) and graphical content (e.g., pictures, logos and other graphical content). In addition, each cover style 46 also may specify a particular palette of colors that are compatible with the associated cover style. Some embodiments may include a blank cover style 46 that does not specify any content placement or color preferences.

A cover style 48 that is selected by the user is displayed in a content specification window 50, where the user may complete the cover content specification process. As shown in FIG. 4, the selected cover style 48 includes a front cover region 50, a back cover region 52 and a spine region 54, each of which includes designated areas for various kinds of cover content elements. For example, in the illustrated embodiment, front cover region 50 includes a header area 56, a title area 58 and several areas 60 for graphical content. Back cover region 52 also includes several areas 62 for graphical content. Spine region 54 is sized to correspond to the computed spinal thickness and height dimensions and includes a computed bounding box area 64 where spinal text content that is selected by the user will be placed. The selected cover style 48 also includes a wrap-around area 66 that extends across the front, back and spine regions 50–54. The wrap-around area 66 corresponds to the location where a wrap-around pattern that is selected by the user may be placed. Some cover styles may include a bleed where graphical content extends outside the trim box, so that after trimming the art extends precisely to the media edge. The user may specify cover content for each of the regions of the selected cover style 48 by selecting (e.g., with a pointing device, such as a mouse) a region and designating the content that is to appear in that region. The user may select cover content from a set of clip art, from user-generated files, or from other locations. The cover content may be in the form of any graphical pattern, including a logo (e.g., a company logo), graphics, pictures, images, and text. The user may modify the designated cover content with a set of tools that may be presented to the user in one or more toolbars 68, 70, 72. Among the tools that are presented to the user may be conventional graphics manipulation tools that may be found, for example, in conventional graphics programs, such as the Macromedia® FreeHand® or Adobe® Illustrator® graphics programs. With the available tools, the user may modify any of the features of the selected pre-generated cover style 48, including the size, shape, color, placement, and the number and style of the pre-generated cover content elements. The user also may use the tools to create a customized cover style from a blank cover style.

Figure 5:
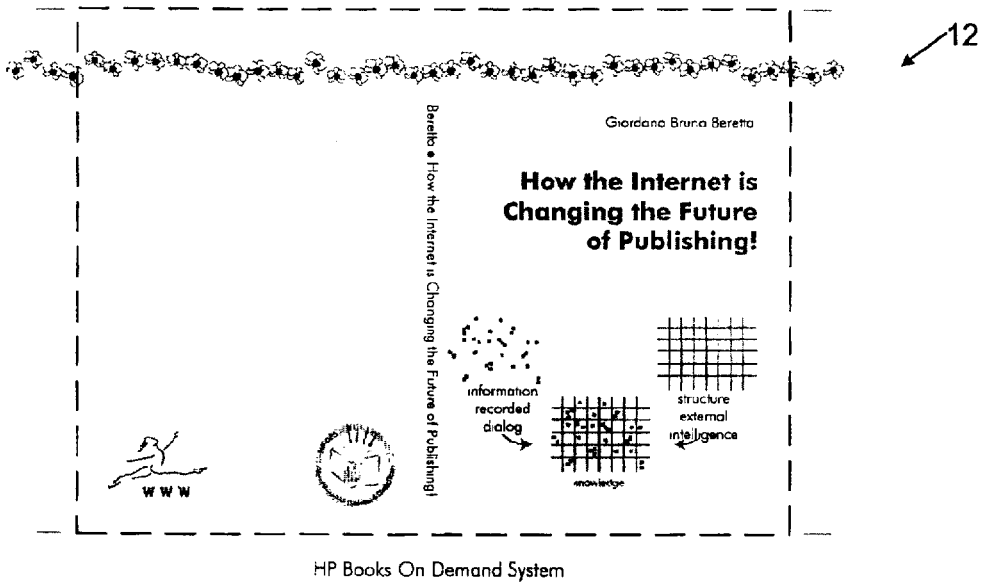
FIG. 5 is a diagrammatic view of a printed cover containing a final content layout composed by the cover authoring tool of FIG. 1.

Referring to FIG. 5, after the user has entered the cover information 18 into the cover authoring tool 10, the cover content layout engine 24 composes the final cover content layout 12 (step 74; FIG. 2). The cover content layout engine 24 is configured to scale the content specified for the front and back cover regions 50, 52 to the computed size of the final printed cover 14. The cover content layout engine 24 also is configured to conform a spinal region of the selected pre-generated cover style to the computed width dimension of the book spine. In this regard, the cover content layout engine 24 is configured to select typeface parameters for spinal text content, which consists of a certain number of characters (or letters). The typeface parameter values may be selected based at least in part upon the number of characters of spinal text content and the height and width dimensions of the book spine. Values may be selected for one or more of the following typeface parameters: weight axis (e.g., from light to black), width axis (e.g., from condensed to extra-extended), style axis (e.g., from sans serif to serif), and optical size axis (i.e., optical adjustment of type so letter proportion, weight, stroke, contrast, and spacing are optimized for readability at a specified point size). The font variation may be selected from the group consisting of a regular font face, a condensed font face, an expanded font face, and a multiple master typeface.

In operation, the cover content layout engine 24 receives from the user the text to be printed onto the book spine and a selected font typeface for the spinal text content. The typefaces may be stored digitally in a database that is accessible by cover authoring tool 10. The typefaces may be stored in a conventional context outline coding format, in which the contours or edges of a letter are described through discrete control points and connected curve elements. An overview of the digital font formats can be found in the book "Digital Typefaces", Peter Karow, Springer Verlag, Berlin Heidelberg, 1992, which is incorporated herein by reference. One or multiple masters may be used for each font type. The masters may be re-scaled according to the desired size, both for low resolution printers as well as for high resolution phototypesetters. Multiple master typeface technology is described in "Adobe Type Library Reference Book", Adobe Systems Inc., San Jose, 1998, which is incorporated herein by reference. In addition to control points, the letters are further defined by instructions that may be used to rasterize the digitally stored font in accordance with a conventional intelligent font scaling process. Alternatively, the digitally stored fonts may be optically scaled to a desired size. The font characters also may be expanded (i.e., widened) or condensed (i.e., narrowed) in accordance with a conventional linear widening or narrowing process, in which both the black letter strokes, as well as the white inner counters in the letters and between the letters in a typeset word, may be widened or narrowed.

In some embodiments, a bounding box 64 (FIG. 4) preferably is computed and used to determine the typeface parameter values based upon a model of an optimal visual fit of the spinal text content within the bounding box. The height of the bounding box is computed to be equal to the computed spine thickness less top and bottom margins, which may be preset or may be selected by the user. The length of the bounding box is computed to be equal to the height of the spine less left and right margins, which also may be preset or selected by the user. For any selected typeface, parameters such as weight axis, width axis, style axis, and optical size axis may be computed automatically for best visual fit within the computed bounding box dimensions. For professional typefaces, the font variation (e.g., condensed, regular or narrow) and the font weight (e.g., light, book, roman, medium, bold, and heavy) may be computed automatically for best visual fit within the computed bounding box dimensions. In the case of multiple master typefaces, the height, weight, style and optical size may be computed automatically for best visual fit within the computed bounding box dimensions. In general, the height (or point size) of the typeface is selected to correspond to the height of the computed bounding box. In some embodiments, the spread, stretch or font variation preferably is selected so that the spinal text content corresponds to a preset or user-selected percentage (e.g., 50–75%) of the length of the computed bounding box. By automatically computing the typeface parameter values based upon the selected visual fit model, the cover authoring tool 10 enables the user to avoid the time consuming, laborious and expensive process of manually composing the final cover content layout with a graphics program, such as the Macromedia® FreeHand® or Adobe® Illustrator® graphics programs.

Referring back to FIG. 2, after the final cover content layout 12 has been composed, it is displayed to the user on GUI 22 for review and approval (step 76; FIG. 2). If the user approves the final cover content layout 12 (step 78), cover authoring tool 10 transmits the final cover content layout 12 to printer 28 (step 80). Otherwise, the process (steps 38, 40, 74, 76, 78) is repeated until the user approves the final cover content layout 12. The user may make any desired changes to the cover content layout, including changing the selected pre-generated cover style (step 38) or changing the cover content information (step 40).

Figure 6:
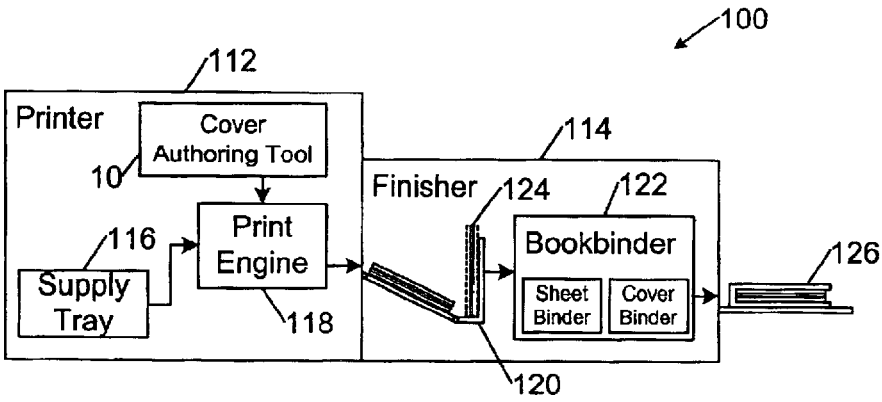
FIG. 6 is a diagrammatic side view of a bookbinding system that incorporates the cover authoring tool of FIG. 1.

Referring to FIG. 6, in one embodiment, cover authoring tool 10 may be incorporated into a bookbinding system 100 that includes a printer 112 and a finisher 114. Bookbinding system 100 may be implemented as a desktop or office bookmaking system designed to satisfy on-demand bookbinding needs. Printer 112 may be a conventional printer (e.g., a LaserJet® printer available from Hewlett-Packard Company of Palo Alto, Calif., U.S.A.) that includes a supply tray 116 that is configured to hold a plurality of sheets (e.g., paper sheets), and a print engine 118 that is configured to apply markings onto the sheets received from supply tray 116. Finisher 114 includes a sheet collector 120 and a bookbinder 122. Bookbinder 122 includes a sheet binder that is configured to bind the text body sheets to one another, and a cover binder that is configured to attach a cover to the bound text body. In operation, sheets are fed from supply tray 116 to print engine 118, which prints text, pictures, graphics, images and other patterns onto the sheets. The printed sheets are fed to sheet collector 120, which collects and aligns the sheets into a text body 124 with an exposed spine bounded by two exposed side hinge areas. The text body 124 is conveyed to bookbinder 122. The sheet binder binds the sheets of text body 124, and the cover binder attaches a cover to the bound text body to produce a bound book 126 with a floating or attached spine.

The systems and methods described herein are not limited to any particular hardware or software configuration, but rather they may be implemented in any computing or processing environment, including in digital electronic circuitry or in computer hardware, firmware or software. The modules of the cover authoring tool may be implemented, in part, in a computer program product tangibly embodied in a machine-readable storage device for execution by a computer processor. In some embodiments, these modules preferably are implemented in a high level procedural or object oriented programming language; however, the algorithms may be implemented in assembly or machine language, if desired. In any case, the programming language may be a compiled or interpreted language. In some embodiments, cover authoring tool 10 may be implemented as a plug-in for the Adobe® Acrobat® document sharing software program (available from Adobe Systems, Inc. of San Jose, Calif., U.S.A.). The cover authoring methods described herein may be performed by a computer processor executing instructions organized, e.g., into program modules to carry out these methods by operating on input data and generating output. Suitable processors include, e.g., both general and special purpose microprocessors. Generally, a processor receives instructions and data from a read-only memory and/or a random access memory. Storage devices suitable for tangibly embodying computer program instructions include all forms of non-volatile memory, including, e.g., semiconductor memory devices, such as EPROM, EEPROM, and flash memory devices; magnetic disks such as internal hard disks and removable disks; magneto-optical disks; and CD-ROM. Any of the foregoing technologies may be supplemented by or incorporated in specially-designed ASICs (application-specific integrated circuits).

Other embodiments are within the scope of the claims.

What is claimed is:

1. A cover authoring tool, comprising:

an interface that receives size information for a document to be bound into a perfectly bound book having a spine characterized by a width dimension and a height dimension, and receives content information for at least a front region and a spinal region of a cover to be attached to the perfectly bound book; and a cover content layout engine that composes a final content layout for the cover, wherein the cover content layout engine scales content received for the front cover region and formats content received for the spinal region of the cover to accommodate the width and height dimensions of the book spine based upon the document size information and the cover content information received through the interface.

2. The cover authoring tool of claim 1, wherein the cover content layout engine computes a thickness dimension of the perfectly bound book from the received document size information.

3. The cover authoring tool of claim 1, wherein the received cover content information includes graphical content and textual content.

4. The cover authoring tool of claim 1, wherein the cover content layout engine selects typeface parameter values for spinal text content consisting of a number of characters.

5. The cover authoring tool of claim 1, wherein the interface additionally receives content for a back region of the cover, and the cover content layout engine additionally scales content received for the back cover region.

6. The cover authoring tool of claim 1, wherein the cover content layout engine computes a bounding box having a height dimension and a length dimension fitted to the spinal region of the cover.

7. The cover authoring tool of claim 2, wherein the received document size information includes type of paper and number of pages in the perfectly bound book.

8. The cover authoring tool of claim 3, wherein the interface comprises a graphical user interface through which a user may specify content and content layout for the cover.

9. The cover authoring tool of claim 8, wherein the graphical user interface presents multiple pre-generated cover styles for selection by the user.

10. The cover authoring tool of claim 9, wherein the cover content layout engine composes the final content layout for the cover based upon a pre-generated cover style selected by the user.

11. The cover authoring tool of claim 4, wherein values are selected for one or more of the following typeface parameters: font size, spread, stretch font variation, and font weight.

12. The cover authoring tool of claim 4, wherein the cover content layout engine selects a typeface parameter value for a stretch font variation from the group consisting of a regular font face, a condensed font face, an expanded font face, and multiple master typeface.

13. The cover authoring tool of claim 5, wherein the interface additionally receives content for a wrap-around region extending across the front region, the spinal region and the back region of the cover, and the cover content layout engine composes the final content layout for the cover with wrap-around content disposed in the wrap-around area.

14. The cover authoring tool of claim 6, wherein the cover content layout engine sets a height-related typeface parameter for spinal text content to the height dimension of the computed bounding box.

15. The cover authoring tool of claim 6, wherein the cover content layout engine sets a width-related typeface parameter for spinal text content such that the spinal text content extends across a selected proportion of the length dimension of the computed bounding box.

16. The cover authoring tool of claim 15, wherein the cover content layout engine sets a width-related typeface parameter for spinal text content such that the spinal text content extends across 50–75% of the length dimension of the computed bounding box.

17. A cover authoring tool, comprising:

an interface that receives size information for a document to be bound into a perfectly bound book having a spine characterized by a width dimension and a height dimension, and receives content information for a cover to be attached to the perfectly bound book, wherein the received cover content information includes graphical content and textual content and the interface comprises a graphical user interface through which a user may specify content and content layout for the cover, wherein the graphical user interface presents multiple pre-generated cover styles for selection by the user; and a cover content layout engine that composes a final content layout for the cover, including spinal content formatted to accommodate the width and height dimensions of the book spine based upon the document size information and the cover content information received through the interface, wherein the cover content layout engine conforms a spinal region of the selected pre-generated cover style to the width dimension of the book spine and composes the final content layout for the cover based upon a pre-generated cover style selected by the user.

18. A cover authoring tool, comprising:

an interface that receives size information for a document to be bound into a perfectly bound book having a spine characterized by a width dimension and a height dimension, and receives content information for a cover to be attached to the perfectly bound book; and a cover content layout engine that composes a final content layout for the cover, including spinal content formatted to accommodate the width and height dimensions of the book spine based upon the document size information and the cover content information received through the interface, wherein the cover content layout engine selects typeface parameter values for spinal text content consisting of a number of characters based at least in part upon the number of characters of spinal text content and the height and width dimensions of the book spine.

19. A cover authoring method, comprising:

receiving size information for a document to be bound into a perfectly bound book having a spine characterized by a width dimension and a height dimension;

receiving content information for at least a front region and a spinal region of a cover to be attached to the perfectly bound book; and composing a final content layout for the cover by scaling content received for the front cover region and formatting content received for the spinal region of the cover to accommodate the width and height dimensions of the book spine based upon the received document size information and the received cover content information.

20. The cover authoring method of claim 19, further comprising computing a thickness dimension of the perfectly bound book from the received document size information.

21. The cover authoring method of claim 19, further comprising presenting multiple pre-generated cover styles for selection by a user.

22. The cover authoring method of claim 19, further comprising selecting typeface parameter values for spinal text content consisting of a number of characters.

23. The cover authoring method of claim 19, further comprising receiving content for a back region of the cover, and wherein composing the final content layout for the cover comprises scaling content received for the back cover region.

24. The cover authoring method of claim 19, wherein composing the final content layout comprises computing a bounding box having a height dimension and a length dimension fitted to the spinal region of the cover.

25. The cover authoring method of claim 21, wherein the final content layout for the cover is composed based upon a pre-generated cover style selected by the user.

26. The cover authoring method of claim 23, further comprising receiving content for a wrap-around region extending across the front region, the spinal region and the back region of the cover, and wherein composing the final content layout for the cover comprises disposing wrap-around content in the wrap-around area.

27. The cover authoring method of claim 24, wherein composing the final content layout comprises setting a height-related typeface parameter for spinal text content to the height dimension of the computed bounding box.

28. The cover authoring method of claim 24, wherein composing the final content layout comprises setting a width-related typeface parameter for spinal text content such that the spinal text content extends across a selected proportion of the length dimension of the computed bounding box.

29. A cover authoring method, comprising:

receiving size information for a document to be bound into a perfectly bound book having a spine characterized by a width dimension and a height dimension;

receiving content information for a cover to be attached to the perfectly bound book;

composing a final content layout for the cover, including spinal content formatted to accommodate the width and height dimensions of the book spine based upon the received document size information and the received cover content information; and selecting typeface parameter values for spinal text content consisting of a number of characters, wherein the typeface parameter values are selected based at least in part upon the number of characters of spinal text content and the height and width dimensions of the book spine.

30. A cover authoring method, comprising:

receiving size information for a document to be bound into a perfectly bound book having a spine characterized by a width dimension and a height dimension;

receiving content information for a cover to be attached to the perfectly bound book;

composing a final content layout for the cover, including spinal content formatted to accommodate the width and height dimensions of the book spine based upon the received document size information and the received cover content information; and selecting typeface parameter values for spinal text content consisting of a number of characters, wherein values are selected for one or more of the following typeface parameters: weight axis, width axis, style axis, and optical size axis.

31. A bookbinding system, comprising:

a sheet composer that formats a document to be bound into a perfect bound and prints the formatted document onto two or more sheets;

a sheet binder that forms from the two or more printed sheets a text body having an exposed spine characterized by a width dimension and a height dimension;

a cover authoring tool comprising an interface that receives size information for the text body, and receives content information for at least a front region and a spinal region of a cover to be attached to the perfectly bound book, and a cover content layout engine that composes a final content layout for the cover, wherein the cover content layout engine scales content received for the front cover region and formats content received for the spinal region of the cover to accommodate the width and height dimensions of the book spine based upon the document size information and the cover content information received through the interface; and a cover binder that attaches the cover to the text body.

32. The cover authoring system of claim 31, wherein the interface additionally receives content for a back region of the cover, and the cover content layout engine additionally scales content received for the back cover region.

33. The cover authoring system of claim 31, wherein the cover content layout engine computes a bounding box having a height dimension and a length dimension fitted to the spinal region of the cover.

34. The cover authoring system of claim 32, wherein the interface additionally receives content for a wrap-around region extending across the front region, the spinal region and the back region of the cover, and the cover content layout engine additionally composes the final content layout for the cover with wrap-around content disposed in the wrap-around area.

35. The cover authoring system of claim 33, wherein the cover content layout engine sets a height-related typeface parameter for spinal text content to the height dimension of the computed bounding box.

36. The cover authoring system of claim 33, wherein the cover content layout engine sets a width-related typeface parameter for spinal text content such that the spinal text content extends across a selected proportion of the length dimension of the computed bounding box.

* * * * *